United States Patent [19]

Scharf

[11] 4,351,093

[45] Sep. 28, 1982

[54] METHOD OF MAKING MODULAR YARNCRAFT

[76] Inventor: Bella Scharf, 7813 20th Ave., Brooklyn, N.Y. 11214

[21] Appl. No.: 33,993

[22] Filed: Apr. 27, 1979

[51] Int. Cl.[3] ..... D04D 7/02

[52] U.S. Cl. ..... 28/149; 428/32

[58] Field of Search ..... 35/18 A, 27; 40/617, 40/605; 46/29; 28/147, 149, 150, 151, 152; 428/14, 32; 289/1.5, 16.5, 17, 18.1; 242/7.01, 7.02, 47, 50; 38/102.4, 102.5

[56] References Cited

U.S. PATENT DOCUMENTS

| | | | |
|---|---|---|---|
| 1,088,480 | 2/1914 | Suraci | 428/32 |
| 1,737,983 | 12/1929 | Stott | 28/152 |
| 2,433,307 | 12/1947 | Thomas | 28/152 |
| 2,940,606 | 6/1960 | Kurnitz | 40/605 X |
| 4,144,660 | 3/1979 | Lamb | 38/102.5 |
| 4,179,830 | 12/1979 | Lamb | 38/102.5 |

FOREIGN PATENT DOCUMENTS

| | | | |
|---|---|---|---|
| 1933259 | 1/1971 | Fed. Rep. of Germany | 40/605 |

*Primary Examiner*—Robert Mackey

*Attorney, Agent, or Firm*—Hubbell, Cohen, Stiefel & Gross

[57] ABSTRACT

A modular yarn craft system is provided wherein preformed central sections having a plurality of rods extending outward therefrom are mateably connectable with each other or tubular members so as to provide a connection zone between the elements having a continuous cross-section for providing a continuous flush modular framework. Yarn is continuously wrapped around that modular framework so as to produce a substantially flush wrapped fiber design.

4 Claims, 31 Drawing Figures

METHOD OF MAKING MODULAR YARNCRAFT

BACKGROUND OF THE INVENTION

1. Field of the Invention

The present invention relates to yarn craft such as the formation of Ojos, and particularly to a method and apparatus for modularly creating such Ojo type arrangements.

2. Description of the Prior Art

The ancient yarn craft of creating colorful yarn covered structures by wrapping yarn about a framework in a geometric pattern to form Ojos or "Eyes of God" was originated in North America by the Pueblo and Mexican Indians. Traditionally, the craft of yarn winding has been worked in a criss-cross manner over a framework composed of wood dowels or flat sticks, which were first crossed to form precise angles between them and were then attached at their centers by either gluing or nailing in order to insure the permanence of these mathematically correct angles. Alternatively, center-notched sticks have been used for forming simple structures like a cross but these simple structures are generally glued together in order to insure the necessary strength at the connection center. In either event, the formation of these arrangements requires skill on the part of the user. Furthermore, such arrangements are not modular and therefore suffer from many drawbacks. For example, while wrapping yarn over sticks to form Ojo type arrangements it is a difficult task, particularly for the unskilled, to maintain the desired geometrically correct structure. It is even more difficult to wrap the yarn over a very large structure or to assemble two or more of the finished designs. Such drawbacks are not present in applicant's system due to both the modularity of the system and the use of preformed cores or center pieces or components, such as pre-molded plastic center components having a plurality of poles protruding radially outward from these center components. These preformed center components may be any desired geometric configuration and, accordingly, the poles would extend planar in several directions forming the exact geometrical configuration, such as a cross, a hexagon, an octagon and the like.

The modularity of the system of the present invention enables the user to gradually work on wrapping poles of modularly increasing length by adding additional length as the previous length becomes wrapped, thereby avoiding the cumbersome arrangements of the prior art which would require the user to start with a fixed length pole. In addition, the modularity of the system of the present invention enables the user to interconnect a plurality of systems through their center components to form much more intricate or sophisticated designs than were possible with the prior art. In the modular system of the present invention, tubes of varying length are mounted to the center components and subsequently wrapped with colored fiber or yarn forming the desired designs. The configuration of the components is such that substantially the same diameter is maintained at the zones of connection so as to insure the continuous flush wrap important to Ojo-type designs. The finished designs associated with a single core may then be interconnected to other such designs to form larger design structures, thereby enabling such larger design to be formed in a modular fashion.

Modularity in a general sense is well known and, thus, model kits for building a wide variety of geometrical structures are well known. These kits, however, have no relationship to the art of forming Ojo-type arrangements. For example, U.S. Pat. Nos. 2,208,049; 2,313,357; 3,698,123 and 814,367 disclose structural toys consisting of long elements connected by various joint pieces, rings and connecting discs to form an architectural structure or a replica of a machine or vehicle. Similarly, U.S. Pat. No. 3,939,581 discloses the use of interlockable plastic tubes and coupling members for building models of organic molecular structures while U.S. Pat. No. 3,469,339 relates to interconnecting plastic tubes of the same diameter which can be inserted through each other in perpendicular relation. None of these arrangements however is even remotely suggestive of yarn craft and, accordingly, none of them discloses the use of a (continuously flush) modular framework for forming Ojo-type arrangements.

As was previously mentioned, the craft of yarn wrapping is an ancient tradition in Mexico as described in a publication entilted "The Creative Ojo Book" by Diane Thomas, Hunter Publishing Comp., Phoenix, Ariz., Copyright 1975. As set out in this publication, prior art Ojo-type arrangements employ wooden elements which form the basic structure which, in order to provide a permanent tight fit and mathematically correct angles at the connection centers, have to be first notched by the user or supplier and then glued and nailed together. As further set out in the publication, mathematically correct angles, such as usually 30°, 45°, 60° and 90°, must be maintained in the framework which may become a problem when attempting to assemble the sticks by gluing or nailing, such as by an unskilled user, specifically when more than two sticks are used. A further disadvantage of this traditional method and system becomes readily apparent if it is desired to form larger structural designs which would be either impossible or extremely difficult to achieve with the traditional methods.

SUMMARY OF THE INVENTION

The present invention provides a simple and inexpensive modular framework for use in yarn craft to form Ojo-type arrangements. The modular framework may be formed by different injection molded plastic members. These plastic members consist of a central section in the form of a preformed geometric configuration, such as a cross, a hexagon, an octagon or the like, having a corresponding number of pole portions extending radially outward from the central section or core. The diameter of each of these pole portions is preferably substantially the same as the diameter of the central section and includes a mounting member coaxially associated therewith. Tubes or pole members which preferably have substantially the same diameter as the central section and the pole portions are mateably connected to the free ends of the pole portions via the associated mounting member in a way so as to provide a connection zone between the tubes and an adjacent pole portion having a continuous cross-section for providing a flush modular framework between the tubes and adjacent pole portions. The framework is then subsequently wrapped with yarn, fiber, wool or the like of various colors and in various designs in the manner used for forming an Ojo-type arrangement. If desired, additional tubes may be connected to a prior mounted tube to extend the length of the framework as the design is being formed. Moreover, additional central sections may be connected together as the design is being formed to create a larger more intricate framework and design. If desired, the various modular components may be provided in a kit form with the potential complexity of the design being primarily dependent on the number of components provided. Moreover, such a modular kit arrangement can enable much less skilled practitioners to get involved in forming Ojo-type arrangements than was previously possible.

DETAILED DESCRIPTION OF THE DRAWINGS

Figure 1:
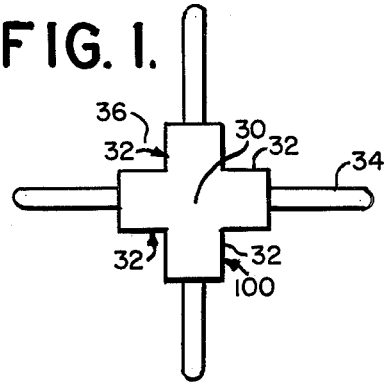
FIGS. 1–3 are plan views of various typical preformed geometrically configured center pieces employed in the presently preferred system and method of the present invention, with FIG. 1 illustrating a cross configuration, FIG. 2 illustrating a hexagonal configuration and FIG. 3 illustrating an octagonal configuration.
Figure 4:
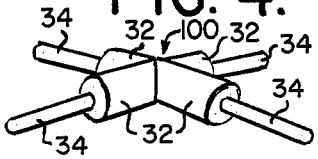
FIG. 4 is a perspective view of the center piece of FIG. 1.
Figure 2:
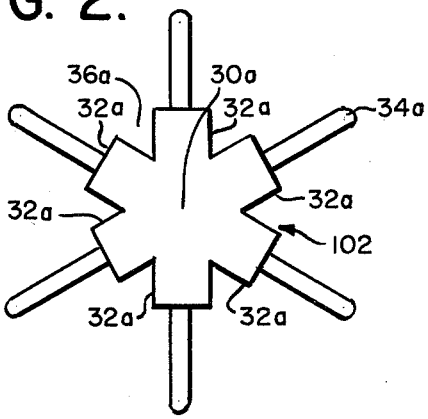
Figure 3:
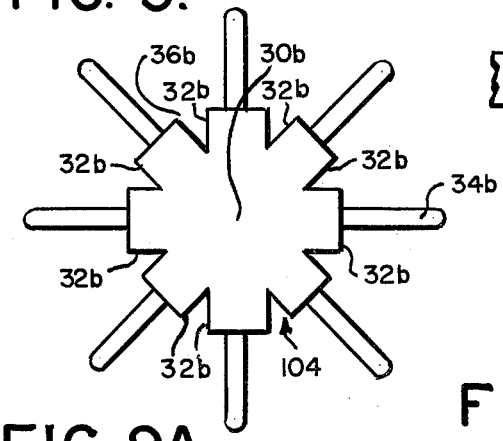
Figure 11:
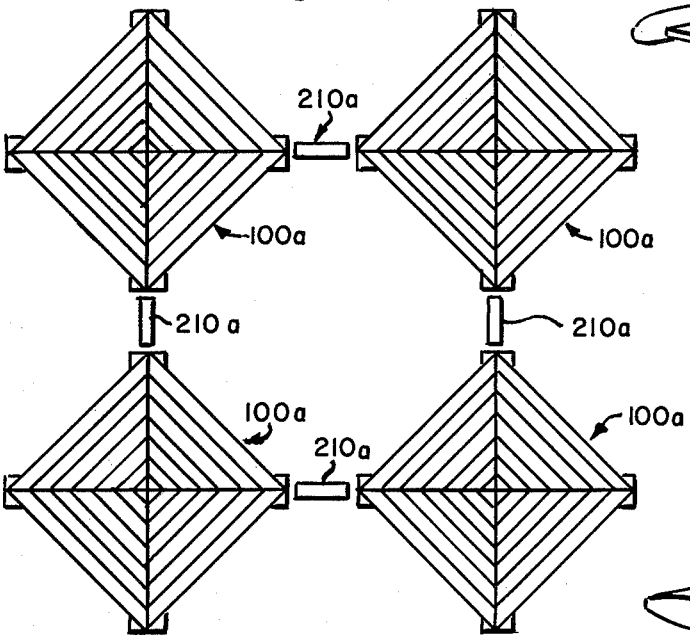
FIG. 11 is an exploded plan view, similar to FIG. 10A, of four such wrapped center pieces interconnected together to form a more intricate design in accordance with the system and method of the present invention.
Figure 13:
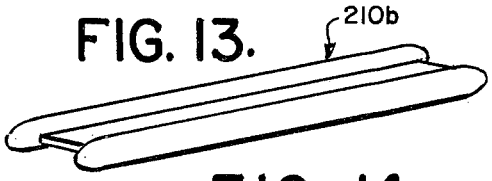
FIG. 13 is a perspective view of a connector member usable with the embodiment of FIGS. 9A–12 in the system and method of the present invention.
Figure 14:
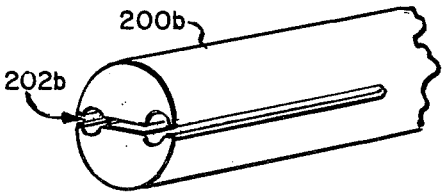
FIG. 14 is a fragmentary perspective view of the female portion of the pole portion of the embodiment of FIGS. 9A–12 for use with the connector member of FIG. 13.
Figure 15:
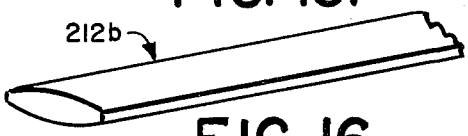
FIG. 15 is a perspective view of an alternative embodiment of the connector member of FIG. 13.
Figure 16:
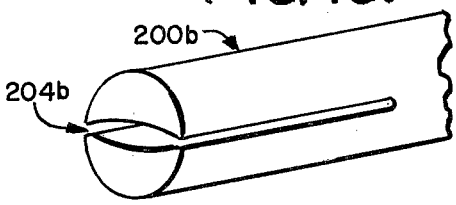
FIG. 16 is a fragmentary perspective view of an alternative embodiment of the female portion of the pole portion of FIG. 14 for use with the connector member of FIG. 15.
Figure 17:
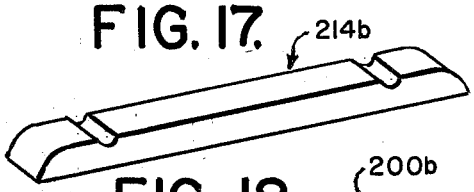
FIG. 17 is a perspective view of an alternative embodiment of the connector member of FIG. 13.
Figure 18:
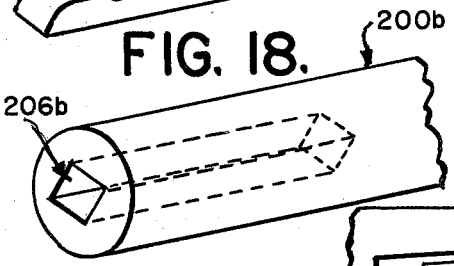
FIG. 18 is a fragmentary perspective view of an alternative embodiment of the female portion of the pole portion of FIG. 14 for use with the connector member of FIG. 17.
Figure 12:
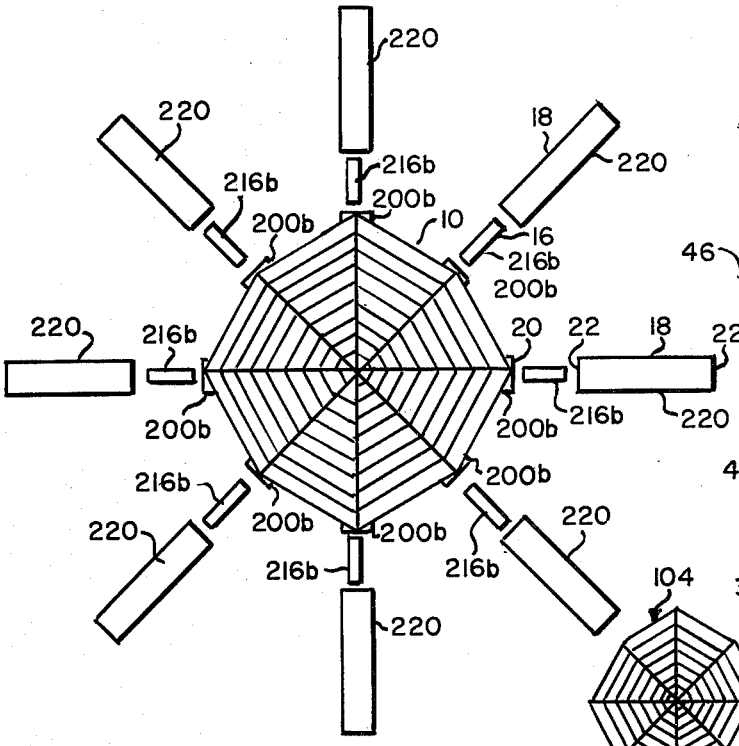
FIG. 12 is an exploded plan view, similar to FIG. 10B, illustrating the extension of the pole portions of the wrapped center pieces of FIG. 10B for enabling an enlargement of the framework and wrapped design in accordance with the system and method of the present invention.
Figure 23:
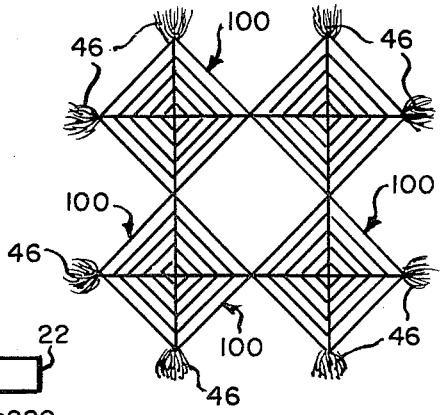
FIG. 23 is a plan view of the framework of FIG. 22 wrapped in accordance with the method of the present invention.
Figure 27:
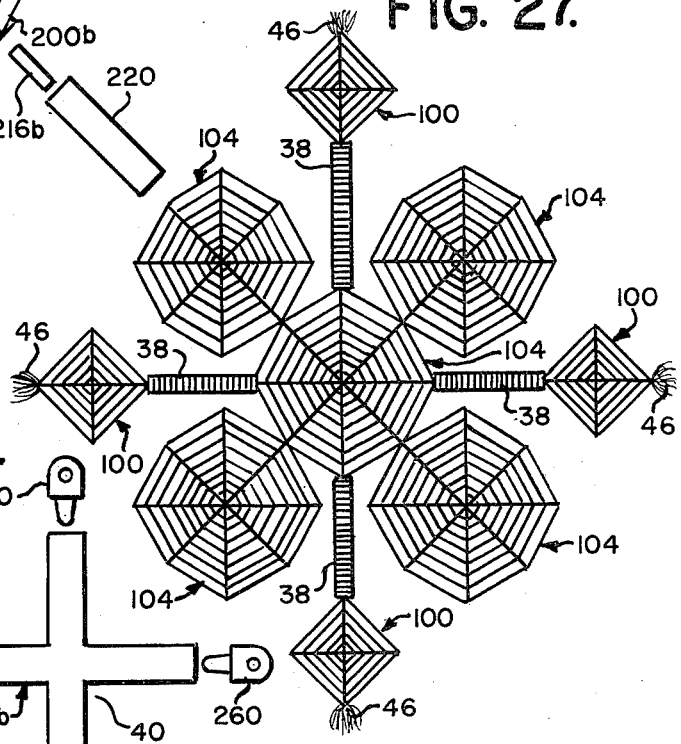
FIG. 27 is a plan view of an alternative intricate design formed in accordance with the system and method of the present invention, the framework employing five octagonal-like center pieces, four cross-like center pieces, four poles, four fringe caps and 12 connectors.
Figure 22:
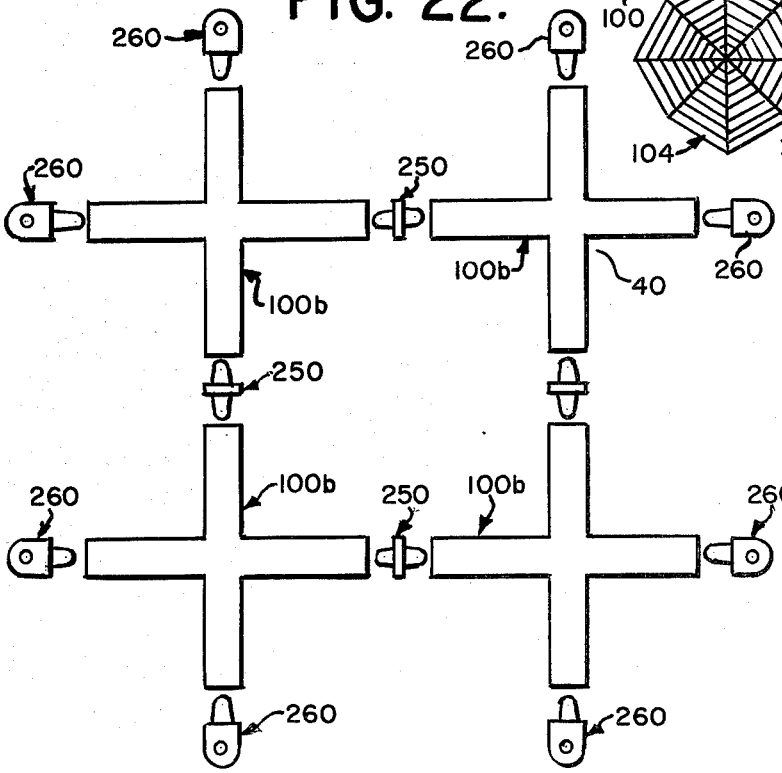
FIG. 22 is an exploded plan view of still another alternative embodiment of a framework for use in accordance with the system and method of the present invention illustrating four cross-like center pieces interconnected together.
Figure 25:
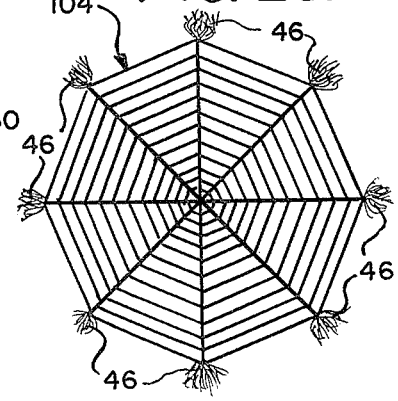
FIG. 25 is a plan view of the framework of FIG. 24 wrapped in accordance with the method of the present invention.
Figure 24:
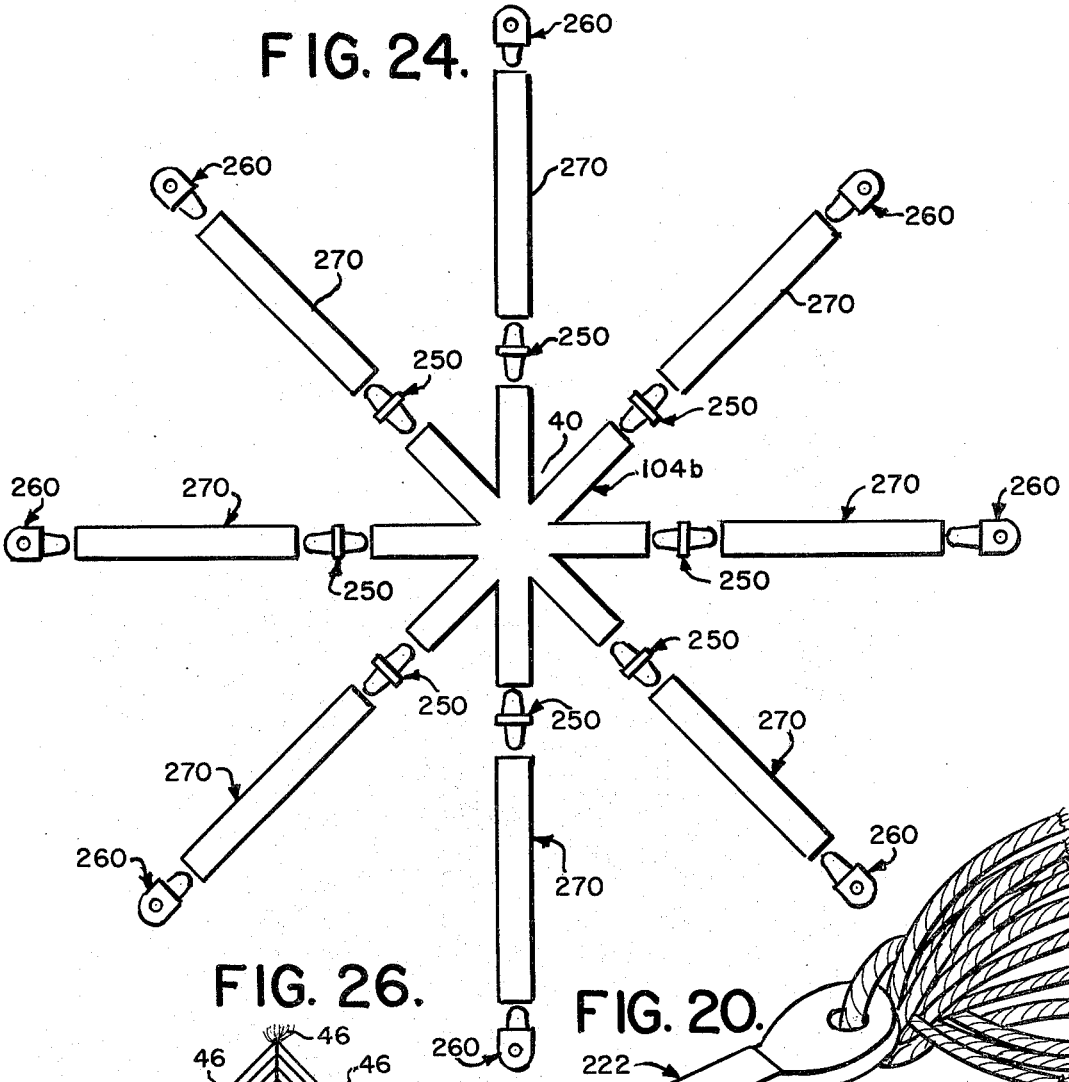
FIG. 24 is an exploded plan view of an octagonal-like center piece, similar to the center piece of FIG. 22, illustrating a framework having the pole portions modularly extended in length.
Figure 26:
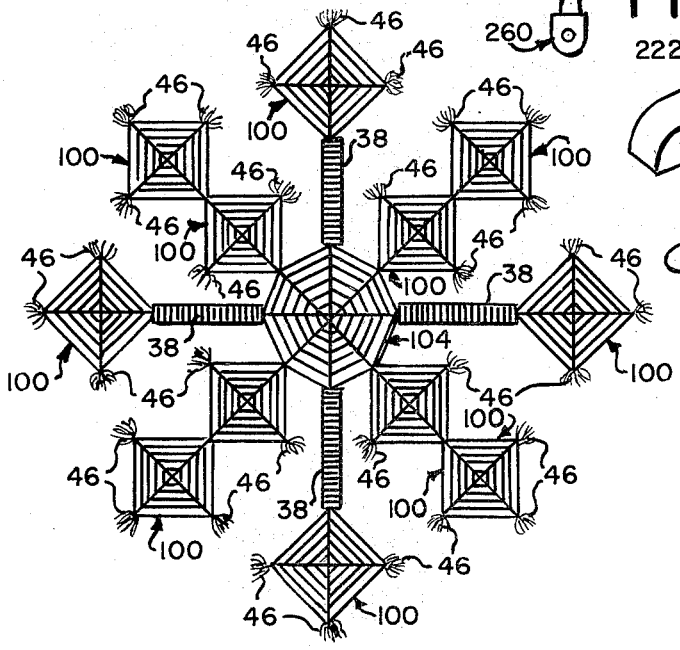
FIG. 26 is a plan view of an intricate design formed in accordance with the system and method of the present invention, the framework employing four poles, 12 cross-like center pieces, one octagonal-like center piece, 16 connector members and 32 fringe caps.

Before describing the figures in detail, it should be understood that many embodiments of the system of the present invention for carrying out the presently preferred method are possible, with FIGS. 1–27 merely illustrating exemplary systems. The presently preferred method of the present invention may briefly be described as employing a preformed center piece having a predefined geometric configuration, such as a cross as illustrated in FIG. 1, a hexagon as illustrated in FIG. 2, or an octagon as illustrated in FIG. 3. This preformed center piece is the basic building block of the modular yarn craft system which enables the formation of simple Ojo-type arrangements such as illustrated in FIGS. 10–10C, or more intricate designs such as illustrated in FIGS. 11 and 23, up to very sophisticated designs such as illustrated in FIGS. 26 and 27. These designs are all built upon the modular building block of the center piece which may be individually wrapped and thereafter assembled into the framework as the overall design is being formed, or may be expanded upon such as illustrated in FIGS. 12, 22 and 24, to increase the size of the Ojo-type arrangement starting from the wrapping of the center piece. As will be explained in greater detail hereinater, this preferred modular system and method for yarn craft enables a relatively unskilled user to create elaborate and beautiful designs such as illustrated in FIGS. 26 and 27.

Figure 5:
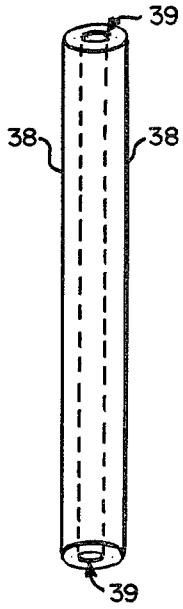
FIG. 5 is a perspective view of a typical tube capable of use with the various center pieces of FIGS. 1–3 in the presently preferred system and method of the present invention.
Figure 6:
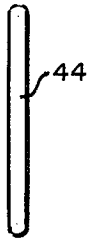
FIG. 6 is a plan view of a typical connector member capable of use with the tube of FIG. 5 in the presently preferred system and method of the present invention.
Figure 7:
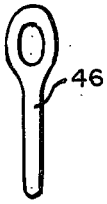
FIG. 7 is a plan view of a typical fringe cap capable of use with the tube of FIG. 5 in the presently preferred system and method of the present invention.

Referring now to FIGS. 1–7, the presently preferred embodiment of the framework portions for use in the system and method of the present invention are shown. FIGS. 1–3 illustrate different typical geometric configurations for the center pieces, with FIG. 1 illustrating a cross-like configuration, FIG. 2 illustrating a hexagonal-like configuration and FIG. 3 illustrating an octagonal-like configuration. Each of the illustrated center pieces 100, 102, and 104, respectively, comprises a central section 30, 30A and 30B, respectively, having a plurality of pole portions 32, 32A and 32B, respectively, radially and substantially symmetrically extending therefrom. Each of these pole portions 32, 32A and 32B, respectively, includes an axially extending member 34, 34A and 34B, respectively, either formed integrally therewith or fixedly secured thereto. If desired, the center pieces 100, 102 and 104 can be integrally formed such as by injection molding. As will be described in greater detail hereinafter, tube-like members or poles 38, such as illustrated in FIG. 5, are mountable to the pole portions 32, 32A or 32B by means of the respective connectors 34, 34A or 34B which are insertable in an axial slot 39 in tube member 38. In this manner, the length of the various pole portions 32, 32A or 32B forming the framework for use in the yarn craft method of the present invention is effectively extended. In this regard, it should be noted that the diameter of the tube member 38 is substantially identical to the diameter of the pole portion 32, 32A or 32B so as to form a continuous flush joint between the adjacent pole portion and tube member when the tube member 38 is mounted on connector 34, 34A or 34B. This characteristic is important to the formation of the Ojo-type arrangement and is true throughout the expansion of the modular framework. Thus, as illustrated in FIG. 6, additional connectors 44 may be inserted in the free end of the tube member 38 to enable the joining of additional adjacent tube members to each other forming flush joints or, alternatively, another center piece 100, 102 or 104 can be mounted to the free end of the tube member 38 by inserting connector 34, 34A or 34B of such center piece into the free end axial slot 39, to form a framework employing a plurality of center pieces, such as illustrated in FIGS. 26 and 27. It should be noted that the presently preferred modular system is not restricted to using center pieces all having the same geometric configuration nor to using any predetermined number of center pieces or tube members. The framework and the resultant design are only bounded by the desires of the user. As further illustrated in FIG. 7, when the design is completed, if desired, fringe caps 46, which may or may not contain tassels, are inserted in the free ends of the tube members 38 to give the design a finished appearance.

Figure 8:
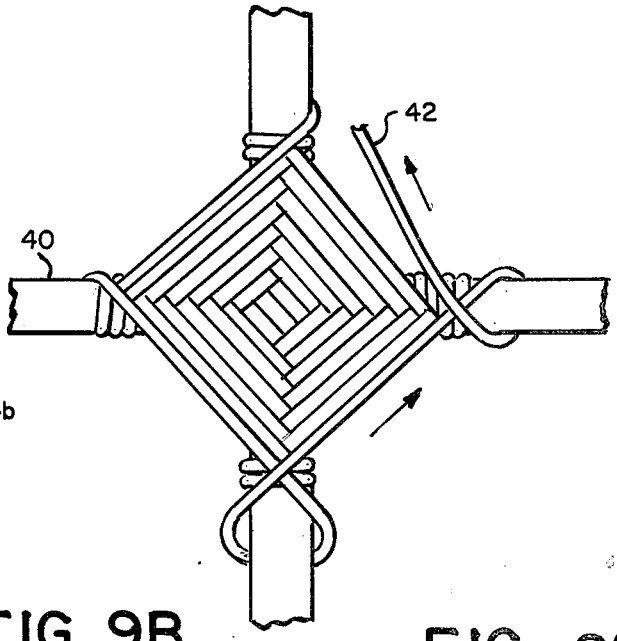
FIG. 8 is a plan view of a partially wrapped framework in accordance with the presently preferred system and method of the present invention with the framework employing the center piece of FIG. 1.

Referring now to FIG. 8, an example of the conventional type of Ojo eye or top wrap is illustrated. This wrap is one of the multitude of conventional type of Ojo wraps which may be employed in the method of the present invention using the system illustrated in FIGS. 1–7 or the alternative systems illustrated in the balance of the figures. Thus, for example, the double eye wrap, the oblong eye wrap, the back wrap, the wing wrap, the spider wrap, the star wrap, the extend wrap, the double color wrap, the candy twist, the chevron twist or twirling may be used in accordance with the preferred system and method of the present invention. Such typical wraps employing conventional Ojo frameworks as opposed to the modular framework of the present invention are illustrated in the aforementioned publication by Diane Thomas entitled "The Creative Ojo Book".

Figure 9A:
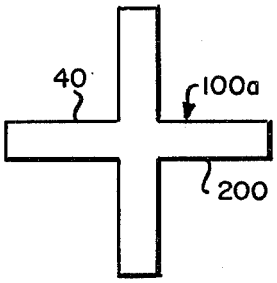
FIGS. 9A–9C are plan views of alternative embodiments of other typical central pieces capable of use in the system and method of the present invention, with FIG. 9A illustrating a cross configuration, FIG. 9B illustrating an octagonal configuration and FIG. 9C illustrating a hexagonal configuration.
Figure 9B:
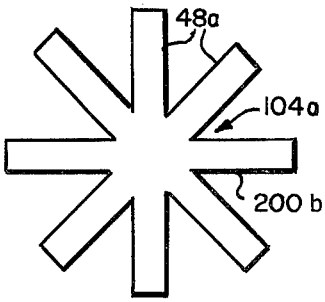
Figure 9C:
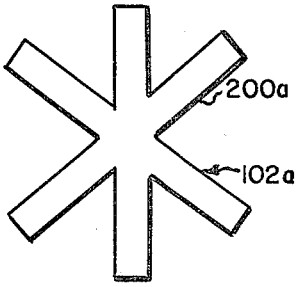
Figure 19:
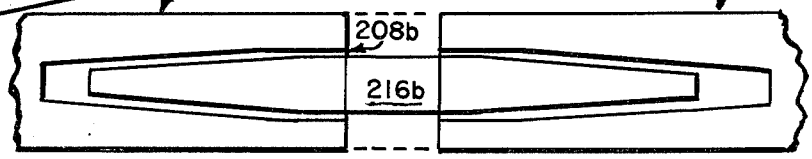
FIG. 19 is a fragmentary exploded side view of still another alternative embodiment of the connector member of FIG. 13 illustrating the flush joining of two adjacent pole members, such as illustrated in FIG. 12.

FIGS. 9A–9C illustrate alternative embodiments of the respective center pieces illustrated in FIGS. 1–3. The primary difference in these preformed center pieces resides in the method of connection of the pole portions to adjacent pole or tubular members. Thus, rather than the male connectors 34, 34A or 34B integrally or fixedly formed as previously described with respect to FIGS. 1–3, the portions of these center pieces 100A, 102A and 104A, which are respectively given reference numerals 200, 200A and 200B, are formed with female portions at their ends such as illustrated in FIGS. 14, 16, 18 and 19, which figures illustratively show various embodiments of the pole portion 200, 200A, 200B. These female portions, such as portion 202B, 204B, 206B, or 208B, modularly connect to adjacent tubular members or poles, or to adjacent center pieces, by means of male connectors, such as connectors 210B, 212B, 214B or 216B, respectively. The male connectors 210B, 212B, 214B and 216B are preferably arranged to be congruent or mateable with the respective female portion as illustrated by FIGS. 13–14, 15–16, 17–18 and 19. Referring to FIG. 19, this figure illustrates such a pole portion 200B immediately prior to its being abutted by the end of an adjacent tubular member 220 mounted thereto by means of connector 216B. As illustrated in FIG. 19, and as shown by dotted lines, when tubular member 220 abuts against pole portion 200B a substantially flush continuous joint will be formed.

Figure 20:
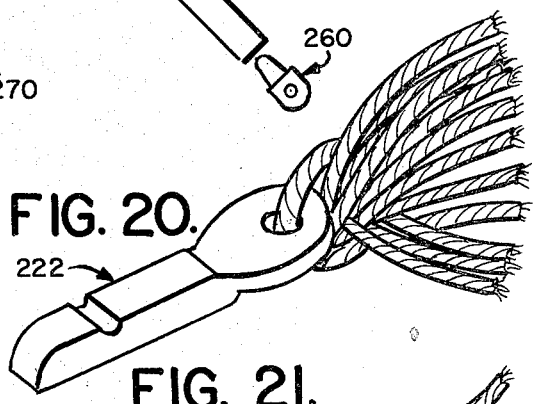
FIG. 20 is a perspective view of a fringe cap for use with the embodiments of FIGS. 17 and 18.
Figure 21:
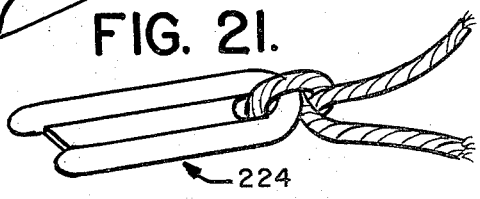
FIG. 21 is a perspective view of an alternative embodiment of a fringe cap for use with the embodiment of FIGS. 13 and 14.

Referring to FIGS. 20 and 21, these figures illustrate tassel containing fringe caps 222 and 224, respectively, which function in the same manner as fringe cap 46 to finish the design formed with a framework using the arrangement of FIGS. 17–18 or 13–14, respectively.

Figure 10A:
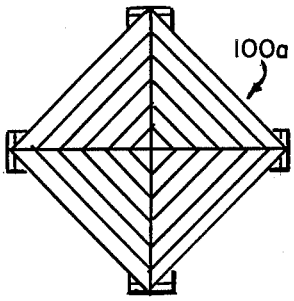
FIGS. 10A, 10B and 10C are plan views, similar to FIG. 8, of the center pieces illustrated in FIGS. 9A, 9B and 9C, respectively, wrapped in accordance with the presently preferred system and method of the present invention.
Figure 10B:
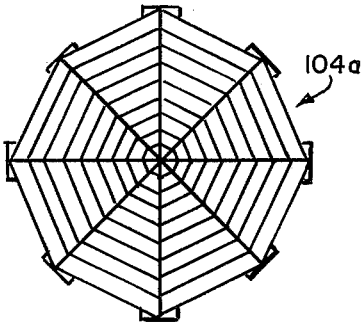
Figure 10C:
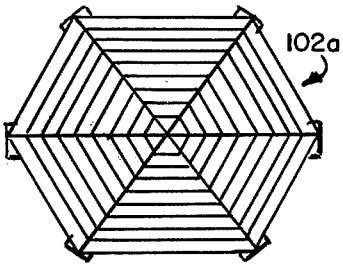

Referring to FIGS. 10A–10C, these figures illustrate the center pieces of FIGS. 9A–9C, respectively, yarn wrapped to form Ojo-type arrangements. FIG. 11 illustrates an intricate design which may be formed in accordance with the method of the present invention by joining together four such wrapped center pieces, such as the wrapped center piece illustrated in FIG. 10A. In accordance with the method of the present invention, the user separately yarn wraps the four center pieces 100A and then joins their pole portions together by the male connectors, such as connectors 210A. Although FIG. 11 illustrates four identical center pieces joined together, there is no such requirement and different geometric configurations of center pieces can be modularly connected together in accordance with the present invention, as illustrated in FIGS. 26 and 27.

Referring to FIG. 12, if instead of forming the intricate design of FIG. 11 the user wishes to expand the size of the design being formed, tubular members 220 may be modularly connected to the respective pole portions 200B via connectors 216B, by way of example, and thereafter the user can continue to wrap the yarn about the now extended poles. This enables the user to start working with a small center piece in a large design without having to initially handle a cumbersome framework.

Referring to FIGS. 22 and 24, still another alternative embodiment of the system previously described is shown, with FIG. 22 illustrating the use of a cross-like geometric configuration 100B having female pole portions connected to adjacent pole portions by male connectors 250 or to fringe caps 260 in the manner previously described. This arrangement is similar to the arrangement previously described with reference to the embodiment in FIG. 11, and such a framework wrapped in accordance with the method of the present invention is illustrated in FIG. 23. Similarly, FIG. 24 illustrates the same system as illustrated in FIGS. 22 and 23 and shows a typical octagonal center piece 104B extended in size by means of tubular member 270 in a manner previously described with reference to FIG. 12. The framework of FIG. 24 wrapped in accordance with the method of the present invention is illustrated in FIG. 25.

Referring now to FIGS. 26 and 27, these figures are illustrative of the sophisticated intricate designs that can be formed by the unsophisticated user in accordance with the modular system and method of the present invention. Thus, assuming the system illustrated in FIGS. 1–7 were employed, the design of FIG. 26 would be formed from the following modular components: four poles or tubular members 38; 12 cross-like center pieces 100; one octagonal-like center piece 104; 16 connectors 44 (not shown) and 32 fringe caps 46. Similarly, the modular framework of FIG. 27, using the same embodiment as described above, comprises the following components: five octagonal-like center pieces 104; four cross-like center pieces 100; four poles or tubular members 38; 12 connectors 44 (not shown) and four fringe caps 46. In creating either of the designs illustrated in FIGS. 26 and 27, the user may separately yarn wrap the various center pieces and thereafter connect them as illustrated in FIGS. 26 and 27 or, where the center pieces are joined to each other via a tubular member 38 rather than directly, the user may first wrap one of the center pieces, attach the tubular member 38 to the appropriate pole portion, continue to yarn wrap the tubular member 38 and thereafter attach the next center piece.

Thus, by utilizing the presently preferred system and method of the present invention, unsophisticated users may create sophisticated designs and, in addition, such arrangements can readily be sold in kit form offering such users a multiplicity of choices.

What I claim is:

1. A method of creating an expandable Ojo-like wrapped fiber design comprising the steps of:

providing a first preformed central section having at least three pole portions extending radially outward from said provided central section and being disposed about said central section;

providing at least one mateable framework member having at least one pole member;

mateably connecting the framework member at its pole member to at least one of said pole portions of said first central section so as to provide a connection zone between the framework member and an adjacent pole portion for providing a continuous substantially flush modularly expandable framework comprising said framework pole member, said pole portions and said first central section;

continuously wrapping yarn around said modular substantially flush expandable framework in an Ojo-like arrangement;

providing a second preformed central section having a plurality of pole portions extending radially outward from said second central section at the periphery thereof, the cross-section thickness of said pole portions being substantially the same as the thickness of said second central section;

continuously wrapping yarn around said second central section and said pole portions in an Ojo-like arrangement for creating a substantially flush Ojo-like wrapped fiber design; and mateably connecting one free end of one of said pole portions extending from said first central section to a free end of one of said pole portions extending from said second central section to form a composite Ojo-like fiber design;

whereby said design may be modularly expanded by modularly enlarging said framework to be continuously wrapped.

2. A method in accordance with claim 1 wherein said framework member comprises at least one additional preformed central section.

3. A method in accordance with claim 1 further comprising the steps of:

providing a third performed central section having a plurality of pole portions extending radially outward from said third central section;

providing at least one mateable additional framework member having at least one pole member;

mateably connecting the framework member to at least one of said pole portions of said third central section so as to provide a connection zone between the framework member and an adjacent portion for providing an additional continuous substantially flush modular framework from said additional framework member, said additional pole portions and said third central section;

continuously wrapping yarn around said additionally provided modular flush framework in an Ojo-like arrangement for creating an additional substantially flush Ojo-like wrapped fiber design; and joining the free end of one of said framework members extending from one of said pole portions of said first and second central sections to the free end of said additional framework member extending from one of said pole portions of said third central section to form a composite Ojo-like sophisticated fiber design.

4. A method in accordance with claim 3 wherein said additional framework member comprises at least one additional preformed central section.

* * * * *